United States Patent [19]

Halliburton

[11] 4,371,164

[45] Feb. 1, 1983

[54] PROJECTED GAMING METHOD AND APPARATUS

[75] Inventor: Ronald D. Halliburton, Fort Lauderdale, Fla.

[73] Assignee: Bally Manufacturing Corporation, Chicago, Ill.

[21] Appl. No.: 122,748

[22] Filed: Feb. 19, 1980

[51] Int. Cl.[3] ..... A63D 3/02

[52] U.S. Cl. ..... 273/121 A; 353/45

[58] Field of Search ..... 273/119 R, 119 A, 121 R, 273/121 A, 237; 358/104; 353/2, 45; 434/25, 26, 29, 40, 44, 69

[56] References Cited

U.S. PATENT DOCUMENTS

| | | | |
|---|---|---|---|
| 3,046,676 | 7/1962 | Hermann et al. | 434/12 |
| 3,245,310 | 4/1966 | Aldcroftt | 353/2 |
| 3,481,604 | 12/1969 | Fan | 273/131 |
| 3,501,217 | 3/1970 | Bottani | 353/2 |
| 3,654,392 | 4/1972 | Beinhocker et al. | 340/323 X |
| 3,728,480 | 4/1973 | Baer | 178/6.8 |
| 3,760,404 | 9/1973 | Khlebutin | 340/323 |
| 3,843,244 | 10/1974 | Facchini | 353/2 |
| 3,844,564 | 10/1974 | Barish | 273/134 A |
| 3,862,358 | 1/1975 | Wolff | 358/104 |
| 4,279,421 | 7/1981 | Tepoorten et al. | 273/237 |

*Primary Examiner*—William M. Shoop
*Assistant Examiner*—Peter S. Wong
*Attorney, Agent, or Firm*—Fitch, Even, Tabin, Flannery & Welsh

[57] ABSTRACT

A projected gaming method and apparatus including a projector, a screen, one or more three-dimensional games and display apparatus, such as a pin ball game and display, a game changer device, a game selector mechanism and player control units. Each interchangeable projectable three-dimensional game and display apparatus is connected to the projector. Each three-dimensional game and display apparatus includes a printed game control system circuit on a printed circuit board, a complete three-dimensional game mechanism and a game display means attached to the other top side of the printed circuit board, all of which are interconnected. The game mechanism and game display means are displayed on the remote screen by the projector. Each game and display is automatically moved into and out of the projector for placement on the screen by the game changer device that is activated by a player actuating the game selector mechanism. The projected face of the game and display is viewed by a player operating the player control unit that is operably connected to the printed game control system circuit.

10 Claims, 12 Drawing Figures

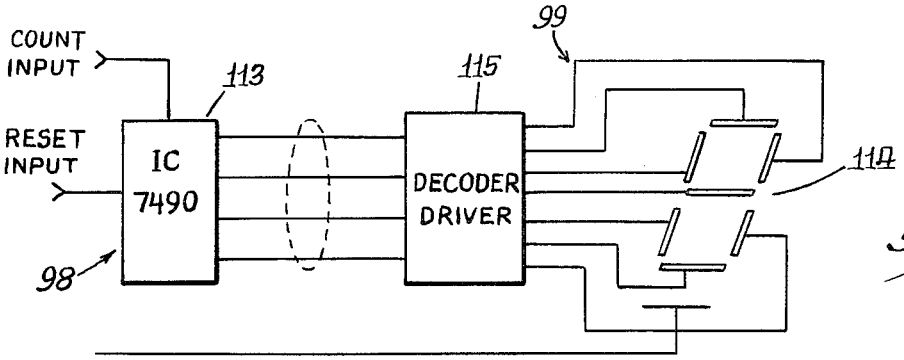
Fig. 10.
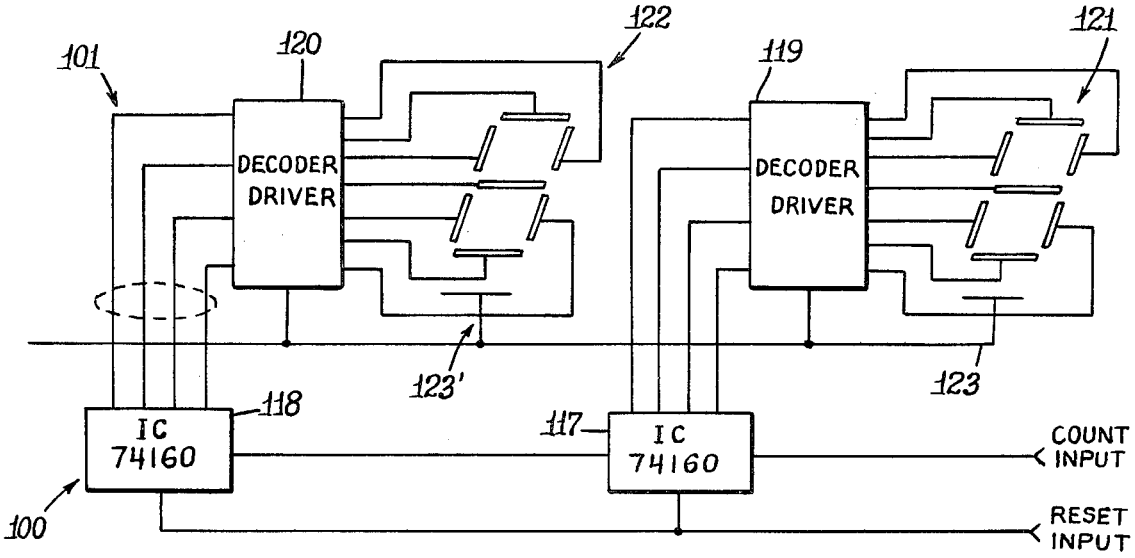
Fig. 11.
Fig. 12.
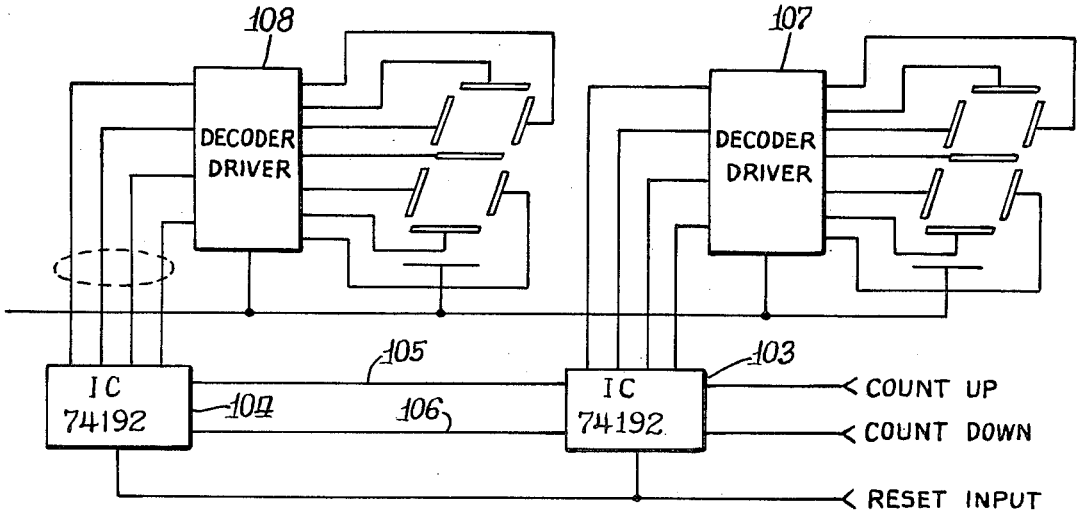

PROJECTED GAMING METHOD AND APPARATUS

BACKGROUND OF THE INVENTION

Various types of devices are commonly used for the generation, display, manipulation, and use of symbols or figures upon the screen of the television tube. Such a device is shown in the Baer patents, one of which is U.S. Pat. No. 3,728,480 and the Gardon Allison U.S. Pat. No. 3,809,395. The use of such games are limited by the skill factor of two dimensional game devices. Projecting apparatus for card games and the like, such as disclosed in Baker Jr. et al, and U.S. Pat. No. 1,919,922 are old in the art.

It is an object of this invention to provide a projected gaming method and apparatus for skill games.

It is another object of this invention to provide a projector in a gaming apparatus to project a three-dimensional mechanical skill game.

It is another object of this invention to provide an interchangeable projected gaming method and apparatus for skill games.

It is another object of this invention to provide an automatic changer apparatus for miniature three-dimensional games of skill in a game apparatus.

Another object of this invention is to provide an automatic changer apparatus for a projector to change miniature mechanical games that are projected on to a screen in a game apparatus.

It is another object of this invention to provide a visual image of the selected three-dimensional mechanical game on a common screen within a playing area in a gaming apparatus having a game changer.

It is a further object of this invention to permit the operation of the selected three-dimensional game by a plurality of control units from anywhere in the viewing area of the screen in a game apparatus.

A further object of this invention is to provide a game structure combining a game control circuit system on a printed circuit board.

A further object of this invention is to provide a mechanical game apparatus on one side of a removable printed circuit board.

A further object of this invention is to provide in a projector a miniature mechanical game and display apparatus on a board.

A further object of this invention is to provide a projectable game display device.

A further object of this invention is to provide a projectable game and display with (LCD) liquid crystal display means for projecting the display onto a remote screen.

An additional object of this invention is to provide an apparatus and method of selecting a plurality of miniature game and display boards, such as records are selected in a juke box.

In accordance with these and other objects, which will be apparent hereinafter, the instant invention will be described with particular reference to the accompanying drawings.

SUMMARY OF THE INVENTION

This invention is for a method of projecting skill games onto a screen for play and to provide interchangeable games and display means. The projected game apparatus includes a projector, a screen, one or more gaming and display apparatus, a game changer device, a game selector mechanism and one or more player control units. A particular game and display is selected by the game selector mechanism and inserted into an opaque projector for display on the screen. The particular game and display is then operated for play by one or more players through player control units. The interchangeable projected three-dimensional game and display apparatus are selectable and changeable by the projected gaming apparatus. Each game and display apparatus is preferably connected on one side of a printed circuit board that has the game and display control circuits on the printed circuit board. The electrical components may be connected to the printed circuit board. The game and display is preferably a complete three-dimensional mechanical gaming mechanism and display means. The display means is preferably a complete game display board connected side by side to the gaming mechanism. The game mechanism and game display is displayed on the screen by the projector. Each game and display is moved into and out of the projector automatically by the game changer device that is activated by the game selector mechanism. The game mechanism and display means being projected is operated by a player from a remote control unit operably connected to the printed game control circuit system, the projector, and the game selector mechanism.

BRIEF DESCRIPTION OF THE DRAWINGS

FIG. 10 is a block diagram of the ball count circuit.

FIG. 11 is a block diagram of the score unit.

FIG. 12 is a block diagram of the credit unit.

DESCRIPTION OF THE PREFERRED EMBODIMENT

Figure 1:
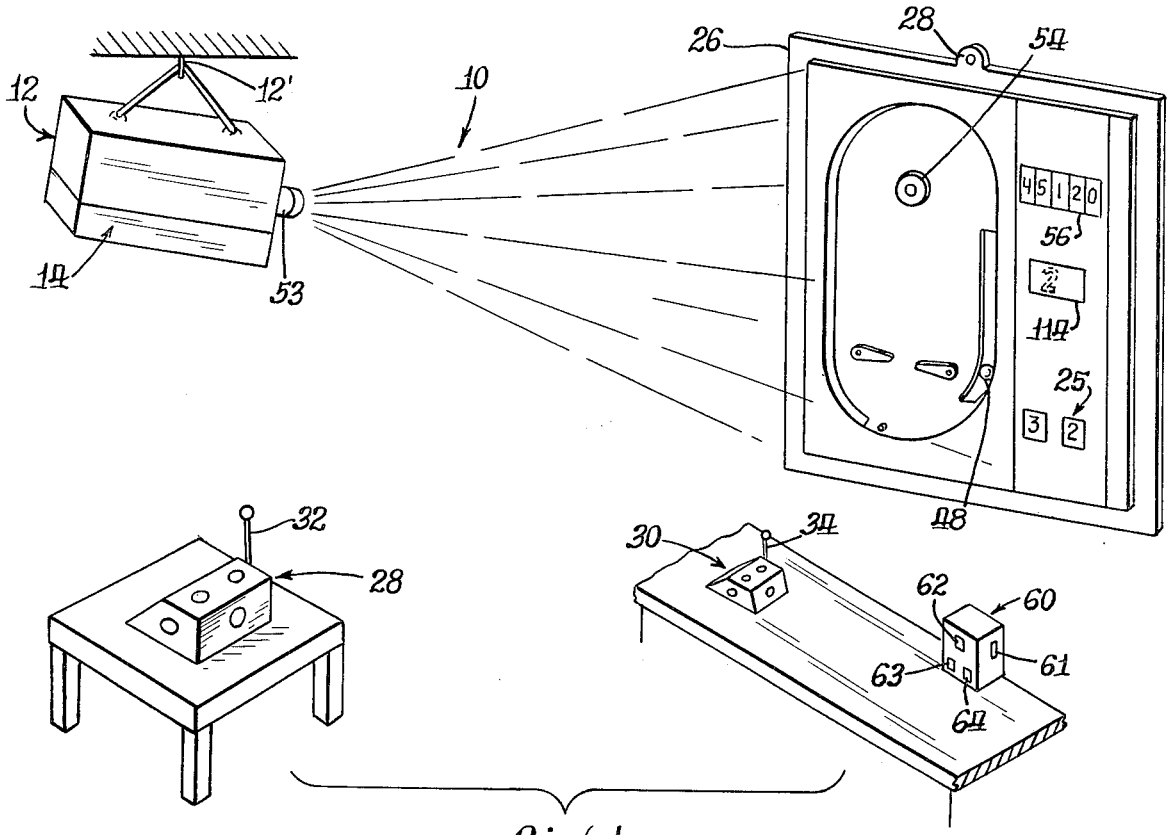
FIG. 1 is a perspective view of the present invention illustrating the apparatus with a hanging projector and game changer device, a facing screen, a remote game selector mechanism, and remote player control units.
Figure 4:
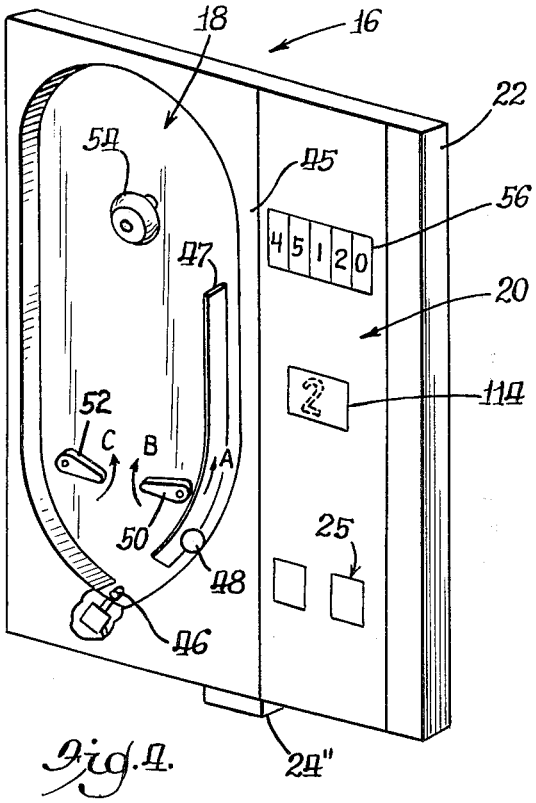
FIG. 4 is a perspective view of the top and two sides of a printed circuit board with a pinball game mechanism and display apparatus on one side of the printed circuit board.

Considering now the present invention in some detail and referring to the drawings, FIG. 1 is an illustration of an embodiment of the present invention. The game apparatus generally illustrated by the numeral 10, includes a projector 12 held on the ceiling by hook 12'. A housing 14 is connected to the lower portion of the projector. The housing contains one or more plug-in three-dimensional games with displays and game changer device. The three-dimensional game and display 16 as shown in FIG. 4 includes a mechanical game mechanism 18, shown as a pinball game, and a game display 20. As shown in FIG. 1, a screen 26 displays the game and game display image. The game selector mechanism 60 allows a player to choose the particular game to be displayed on screen 26.

The game mechanism and game display shown in FIG. 4 are interconnected by electrical circuits on the printed circuit board 22. The board 22 includes the male electrical plug 24" for interconnecting the board 22 to the projector 12, the game changer device, the player control units 28 and 30 shown in FIG. 1, and the other circuitry. A projector screen 26 is connected to the wall by hook 28. The screen 26 receives the image projected by the projector 12 as shown. A plurality of player control units 28 and 30 are connected to the electrical circuitry of the game apparatus through antennae 32 and 34 or electrical wires. The game selector mechanism 60 is initially actuated by use of a coin in slot 61 or by actuating a button for non-coin operation. Then the particular game is selected by activating one of the buttons 62, 63 or 64. The buttons 62, 63 or 64 drive motor 78, shown in FIG. 7, to position one game for projection onto the screen 26.

Figure 6:
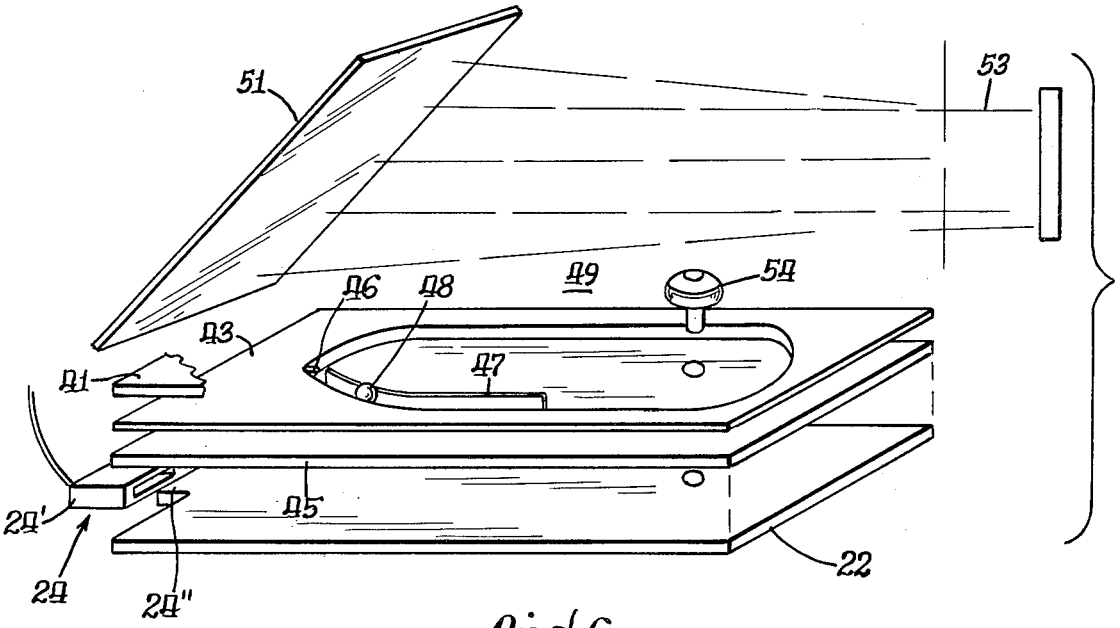
FIG. 6 is an illustration of the inside of a projector and an assembly view of a printed circuit board with a pin ball game illustrated thereon.

After the circuitry is initially activated by mechanism 60, an initial input signal is transmitted from a remote control unit 28 shown in FIG. 1 to produce an output signal capable of actuating the mechanical components of the miniature game 18. The electronic circuitry shown in FIG. 8 can be assembled by a person skilled in the electronic game art to perform a variety of desired functions. The miniaturized game 18, shown for illustration purposes only, may functionally be an exact duplicate of any standard size pinball game now, or in the past, on the market. Many such circuits are disclosed in prior patents. Such a miniaturized game will have mechanical components performing identical function as ordinary games. Other types of three dimensional skill games may be substituted for the illustrated game. The miniature game 18 as shown in FIG. 6 including a glass cover 41, a frame 43, and base 45 are connected together for attachment to the top of the printed circuit board 22. The size of the playing field is limited in size by the size of the viewing area in the particular display apparatus, that is the projectable field of view of the projector 12. A portion of the projector 12 is shown in FIG. 6. The printed circuit board 22 has a male plug 24" at one end which mates with a female connector 24' that is interconnected to the other operational circuits in the projected game apparatus.

Figure 2:
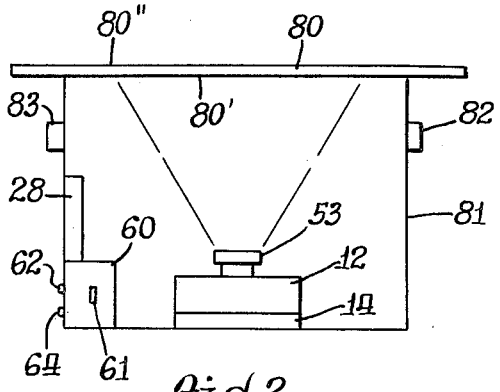
FIG. 2 is a side view with the front panel removed illustrating a second embodiment of the apparatus housed in a gaming table.

The projector or opaque projector 12 is a conventional unit and will not be described in detail except to the extent required for a full understanding of the present invention. The operation of a projector is set forth on pages 196 and 197, *The Way Things Work,* published by Simon & Schuster, Library of Congress Catalog Card No. 67-27972. The opaque projector 12, shown in FIGS. 1 and 6, has at its base an aperture 49 for viewing and projecting the game means shown in FIG. 6 or the game and display means 16 as shown in FIG. 2. The game and game display is projected by a mirror 51 through lenses 53 onto screen 26, see FIGS. 1 and 6.

Figure 7:
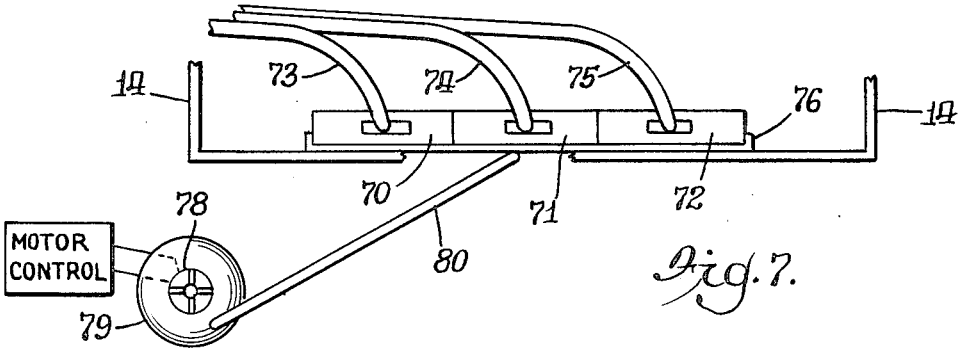
FIG. 7 is a side view illustrating the games and game changer device.

The housing 14 may include two, three or more games and game displays, such as games 70, 71 and 72 shown in FIG. 7, connected into the apparatus circuit by wires 73, 74 and 75. The three games 70, 71 and 72 are connected to tray 76 that is movable to the left or to the right in housing 14 by stepping motor 78. The stepping motor 78 includes driving linkage means 79 and 80. The motor 78 drives the game and display 70, 71 or 72 into a field of view position illustrated by letter D. The game in position D is projected onto the screen 26.

Figure 5:
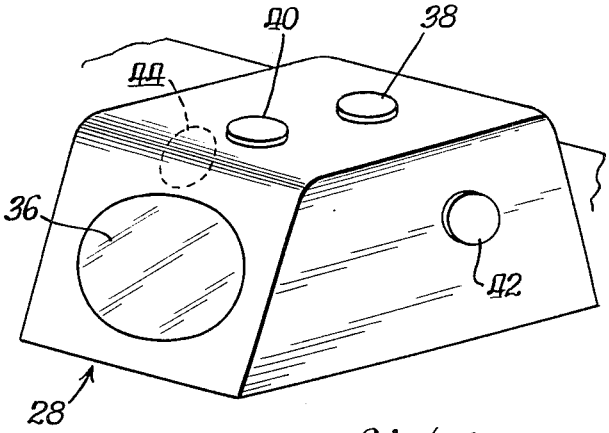
FIG. 5 is a perspective view of a control unit.

The player control units, as shown in FIG. 5, include speakers 36 for the audio sound, start button 38 to condition the system, hammer or shoot button 40, and flipper buttons 42 and 44. The player control unit allows the player to control the operation of the game mechanism which in turn operates the game display. The start button 38 shown in FIG. 5 allows a player to activate the control unit and game mechanism. The shoot button 40 actuates the solenoid actuated hammer 46, shown in FIGS. 4 and 6, to drive ball 48 in the direction of arrow A. The ball is first moved through the channel bounded by guide 47, and the right side of the frame member 45. The flipper buttons 42 and 44 move flippers 50 and 52, respectively, in the direction of the arrows B and C. When the ball 48 hits bumper 54 the scoring mechanism is activated and the display device 20 displays the score in LCD display means shown at 56.

The particular circuit board 22, shown in FIG. 6, includes the necessary circuits and electronic components arranged on the bottom of the board to control both the game mechanism and game display. The miniature size mechanical game, of skill 18, shown as a pinball game may be replaced by other games such as a baseball game, or target games arranged on the top of the circuit boards. 22.

Referring now to FIG. 2, showing a second embodiment of the device, the projector 12 projects the image of the game from housing 14 through the projector 12, and lens means 53 onto the screen 80. The image of the game is displayed on the bottom side of screen 80 at 80' and may be viewed from the opposite side of 80" of the screen 80. The projector is housed in a case 81 that may be in the form of a table. The game selector mechanism may be in the container 81 at 60. The coin slot 61 and selector buttons shown as 62 and 64 are accessable to the players seated around the table. The player control unit 28 may also be incorporated in casing 81. The bumper control means and the shooting control means may be included in a single control arm 82 and 83 that rotate and move in and out for the shooter and flipper.

Figure 3:
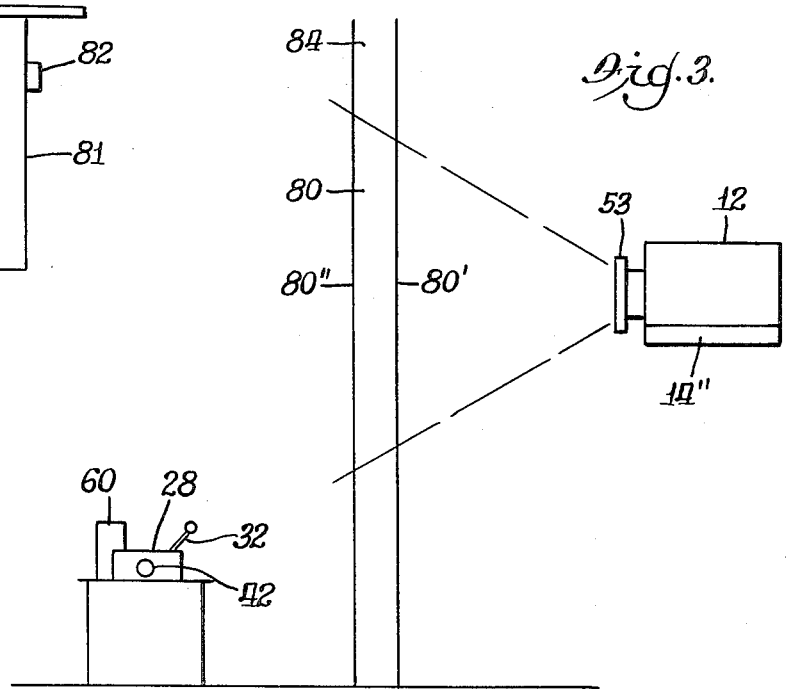
FIG. 3 is a side view with a wall in cross section illustrating a third embodiment of the apparatus with the projector on the side opposite the viewing side of the screen.

Another embodiment of the invention is shown in FIG. 3. The projector 12 includes housing 14". Lens 53 is attached to projector 12. The projector is positioned on the right side of wall 84. The image from the projector is projected onto surface 80' of viewing screen 80. The image may be viewed from the left side of the screen 80, that is, surface 80". The game selector mechanism 60 and the player control unit 28 may be positioned in the room on the left side of wall 84. The player control unit 28 may include antenna 32 as well as the various control knobs as shown in more detail in FIG. 5.

Figure 8:
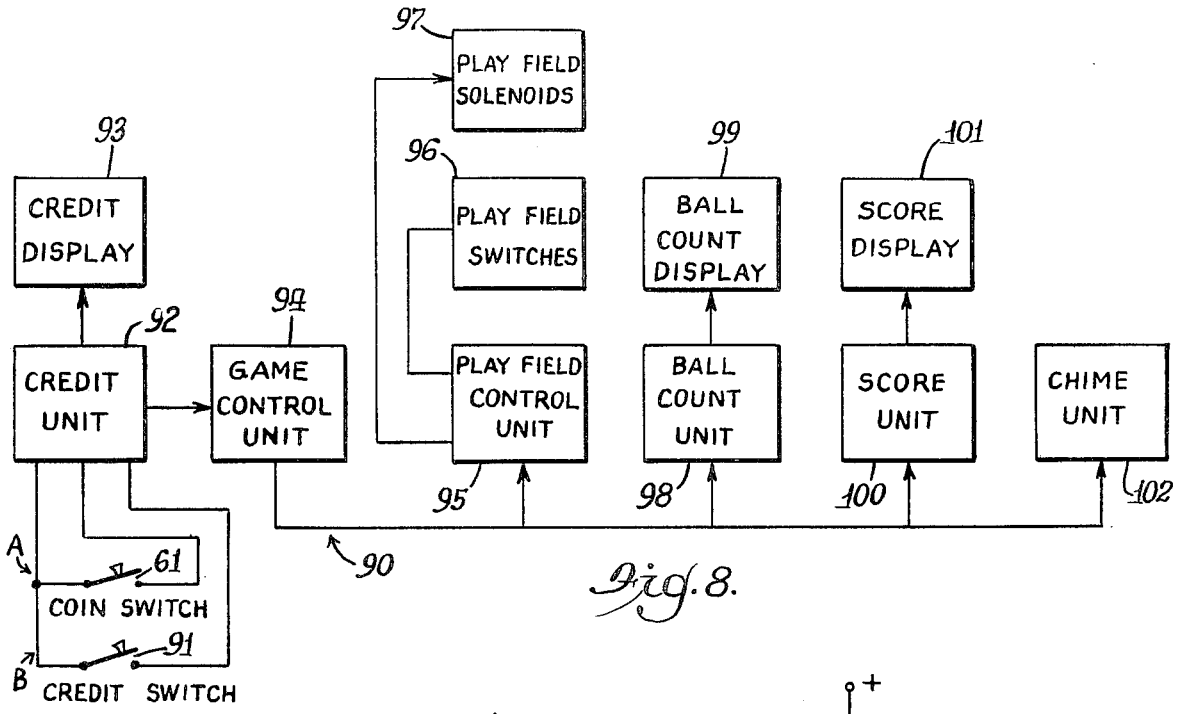
FIG. 8 is a block diagram of the entire control circuit.

Referring not to FIG. 8, a block diagram of the entire control circuit is shown except for the game selector circuit that may be similar to a record juke box selector control circuit. The control circuit is generally designated by numeral 90, and is actuated and placed into an initial operational mode by actuating control switch 61 that may be a coin operated switch as illustrated in FIG. 1. The adjustable credit switch 91 in FIG. 8 may be adjusted to provide one, two or more plays or credit units for each coin entering and actuating coin switch 61. This may be accomplished through relay means, not shown, that actuates switch 91. The coin switch means may provide for two or more players. The credit unit circuit actuated by switch 91 is shown by numeral 92. The credit unit circuit is a standard type credit unit circuit, the configuration of which is well known in the art. The credit unit circuit provides signals for a credit display 93. The credit display 93 provides a visual display at 25 shown in FIG. 4. The credit unit 92 and credit display 93 are shown in more detail in FIG. 12 which is set forth hereinafter in more detail.

The credit unit 92 actuates the game control unit 94 in FIG. 8. Game control units such as 94 are well known and in and of itself is not the patentable improvement disclosed herein. The game control unit 94 is connected to and controls the playfield control unit 95, the ball count unit 98, the score unit 100, and the chime unit 102. The playfield switches 96 interact with the playfield control unit 95. The playfield control unit interacts with the playfield selanoid 97. The ball count unit interacts with the ball count display 99 to provide a visual display. The score unit 100 interacts with the score display 101 to provide a visual display. The chime unit 102 is actuated directly to produce an audio sound.

Figure 9:
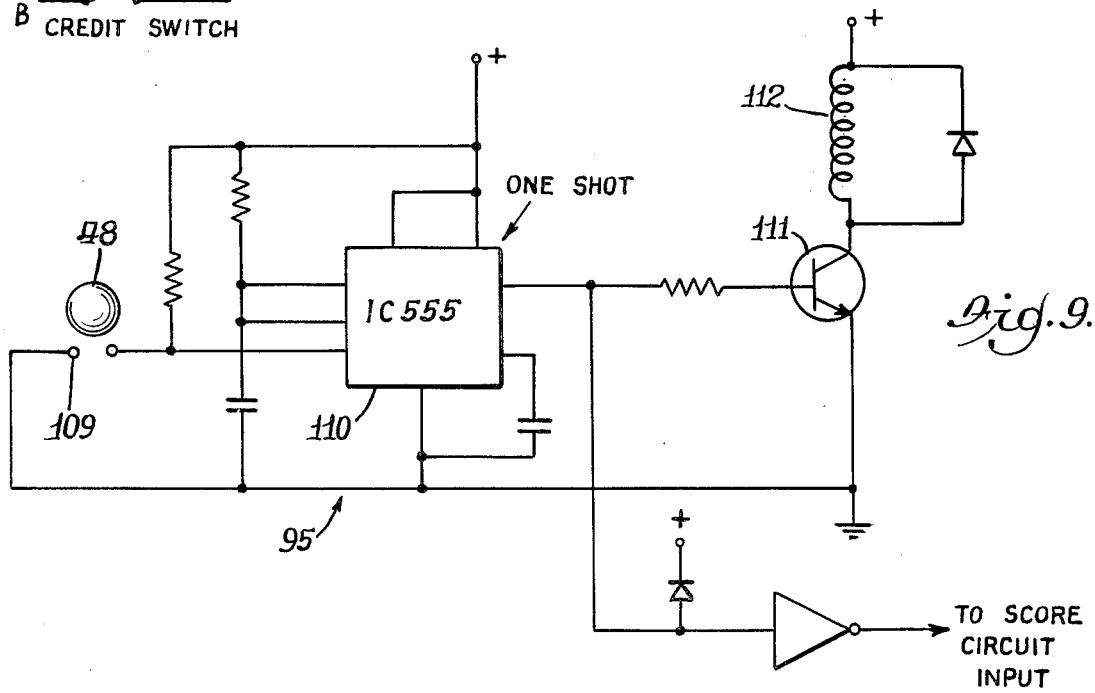
FIG. 9 is a block diagram of the playfield control circuit.

The playfield control unit 95 will accept signals from the playfield switches in bumper 54 that are activated by the impact of ball 48. The playfield control unit 95 sends signals to the score unit 100 and the playfield solenoid that engages the ball 48 moving the ball 48 away from the bumper 54, as shown in FIGS. 8 and 9. Therefore when the ball 48 hits a bumper 54 the electrical connection or switch in the bumper 54, a part of the playfield switches 96, creates a signal transmitted to the score unit 100 which tabulates the amount of points to be displayed in score display 101. The signal is also transmitted to the chime unit 102 to generate the audio sound effects.

The game board 45 is tilted downwardly to the left as illustrated in FIG. 6. The ball 48 rolls down to a terminal position adjacent the shooter 46. Whenever the ball goes into the shooter position, that is, the out hole, the game control unit 94 will signal the ball count unit 98 to advance one game or one player in an ordinary and well known manner. The projector gaming apparatus may be designed to store information in reference to whether there is one or two or more persons playing as well as the number of games to be played. The credit display 93 may indicate how many coins are placed into the system, or how many games have accumulated either by insertion of a coin and/or by the number of games won and accumulated as generated credits. The credit unit and credit display interprets and displays the number of game credit units available to players at a given time.

Referring in detail to FIG. 12, when the coin is deposited it operates a coin switch which provides a count up signal to count (up and down) IC circuits 103 and 104. Line 105 and line 106 transmit count up and down signals between IC 74192 circuits. The IC's first count up the number of games to be played. The credit display 93 includes decoder drivers 107 and 108 and a complementary metal oxide semiconductor binary to seven segment decoder driver. The display connected to the decoder drivers is a filed effect liquid crystal display (LCD). Line 109 is connected to a 100 Hz clock, 50% duty cycle. The credits are counted down through count down signals until the termination of each game cycle. A reset imput is used to readjust the circuit for repeated play, in the normal manner; this may be a signal generated by player control button 38.

Referring now to FIG. 9, showing the typical player control circuit 95, the player control circuit 95 includes the bumper switch illustrated by numeral 109 that is closed by the ball 48. The ball actuates integrated circuit 110 which may be an IC 555. The integrated circuit 110 activates transistor 111 for approximately one half a second in order to activate coil 112 that propels the ball away from bumper 54. The output signal from the integrated circuit timer wire is also transmitted to the score unit 100 and to the chime unit 102.

Referring now to the chime unit 102; it may be a mechanical unit consisting of a plurality of solenoids striking metal bars that generate three or more different sounds. The chime unit provides an audio sound during the ball's contact with switches, such as switch 109.

A typical ball count circuit, shown in FIG. 10, includes integrated circuit 113, such as an IC 7490. Integrated circuit 113 has a count input and a reset input. The IC 113 actuates the display means 99 that consists of a field effect liquid crystal display (LCD). The field effect display 114 provides information as to the ball being played. The LCD is driven by decoder driver such as Mc14543 shown as 115. The decode driver 115 is a CMOS BCD to 7 segment decoder driver. The LCD, backplane 116 is connected to a 100 Hz clock, 50% duty cycle. The LCD provides a projectable display image that can be driven by a printed board circuit for a miniature game and game display.

Referring now to FIG. 11, a typical score unit 100 is illustrated with a two digit display including score display 101. The score unit has a count input and a reset input into two IC's 117 and 118, respectively, both of which may be an IC 74160. The IC's 117 and 118 drive the decode drivers 119 and 120, respectively, to display the scoring digit on the field effect liquid crystal display's (LCD) 121 and 122, respectively. The LCD common backplane 123 and 123' are connected to 100 Hz clock, 50% duty cycle.

The game control unit 94 may be any of the well known types that are associated with pin ball, baseball or other games. Prior art patents showing a total game control unit is old. All various well known pinball machines include published wiring and circuit diagrams for maintenance purposes with such games. The miniaturization of the game circuit is not in and of itself the invention disclosed, and herein is not set forth as patentable subject matter with the exception of the invention for utilizing the LCD displays to provide projectable numeral displays onto a screen such as 26 in FIG. 1.

In use, the projected gaming method includes the use of a projector, a screen, one or more three-dimensional games and display apparatus, such as a pinball game and display, a game changer device, a game selector mechanism and player control units. A particular interchangeable projectable three-dimensional game and display apparatus is connected to the projector. The projector is turned on to project the game and game display onto the screen. The game control system, including the game control unit, is activated. The player control unit is activated remotely to provide a changing image on the screen display.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A projected gaming apparatus comprising:

an opaque projector;

a screen positioned to receive projected images from said opaque projector;

at least one three-dimensional game of skill having a viewable face that presents an opaque image positioned in said opaque projector for display of said viewable face on said screen, and at least one player control unit for controlling events in said game, said player control unit connected to said game and said projector to control the operation of said projector and said game while the image of said viewable face is displayed on said screen for viewing.

2. A projected gaming apparatus as set forth in claim 1 including:

said opaque projector having a viewing area for objects being projected upon said screen;

a game changer device connected adjacent to said projector viewing area, said game changer including an actuating means to move a plurality of said games into said projector viewing area, whereby each game face is automatically moved into and out of said projector viewing area for placement of the image of said game face on said screen by activating said game changer device;

a game selector mechanism connected to said game changer device whereby a player may actuate said game changer device prior to manipulation of said player control unit.

3. A projected gaming apparatus as set forth in claim 2 wherein:

each three-dimensional game includes a printed game control system circuit on one side of a printed circuit board, and a complete three-dimensional game mechanism attached to the other side of the printed circuit board.

4. Apparatus as set forth in claim 1 having a scoring display apparatus, having a viewable face positioned in said opaque projector for projection of said viewable face on said screen.

5. A projected gaming apparatus as set forth in claim 3, wherein:

said display includes LCD means.

6. Apparatus as set forth in claim 1 wherein said game is playable with said viewable face facing generally upwards.

7. A projected gaming method consisting of the steps of:

placing at least one three-dimensional game of skill having an opaque viewing face into an opaque projector;

projecting said viewing face of said three-dimensional game onto a remote screen; and operating the game to control events in the game while viewing the remote screen.

8. A projected gaming method as set forth in claim 7 including:

operation of a game changer device to place a second game having an opaque viewing face automatically into the opaque projector and replacing the first game for projection on the screen of said viewing face of said second game.

9. A method according to claim 8, including placing a scoring display apparatus having a viewable face into said opaque projector and projecting said viewable face of said scoring display apparatus along with said opaque viewing face of said game onto said screen.

10. A method according to claim 8, wherein said game is playable with said viewing face facing generally upwards.

* * * * *